US009062475B1

(12) United States Patent
Shamp et al.

(10) Patent No.: US 9,062,475 B1
(45) Date of Patent: Jun. 23, 2015

(54) ROSELESS TRIM FOR ARCHITECTURAL HARDWARE

(71) Applicant: Sargent Manufacturing Company, New Haven, CT (US)

(72) Inventors: Donald T. Shamp, Northford, CT (US); Scott B. Lowder, Orange, CT (US); Gregory Oleksik, Hamden, CT (US); Thomas Courtemanche, New Haven, CT (US); Darren C. Eller, East Lyme, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 14/017,628

(22) Filed: Sep. 4, 2013

Related U.S. Application Data

(62) Division of application No. 12/836,206, filed on Jul. 14, 2010, now Pat. No. 8,544,903.

(60) Provisional application No. 61/225,325, filed on Jul. 14, 2009.

(51) Int. Cl.
*E05B 3/00* (2006.01)
*E05B 15/00* (2006.01)

(52) U.S. Cl.
CPC ..... *E05B 15/0033* (2013.01)

(58) Field of Classification Search
CPC ..... E05B 85/16; E05B 63/06; E05B 53/003
USPC ..... 292/1.5, 137, 140, 143, 163, 169, 292/169.17, 169.22, 173, DIG. 52, DIG. 62, 292/336.3, DIG. 54; 70/107, 108, 109, 110, 70/111, 224, DIG. 57, 479
See application file for complete search history.

(56) References Cited

U.S. PATENT DOCUMENTS

| | | | | | |
|---|---|---|---|---|---|
| 1,663,417 | A * | 3/1928 | Schunck et al. | ..... | 292/355 |
| 2,759,754 | A * | 8/1956 | Kaiser | ..... | 292/347 |
| 2,998,273 | A * | 8/1961 | Unetic | ..... | 292/169.15 |
| 3,228,281 | A * | 1/1966 | Holt | ..... | 340/979 |
| 4,067,599 | A * | 1/1978 | Ohno | ..... | 292/356 |
| 4,453,753 | A * | 6/1984 | Fayerman et al. | ..... | 292/348 |
| 4,728,133 | A * | 3/1988 | Valley | ..... | 292/336.3 |
| 4,877,278 | A * | 10/1989 | Valley | ..... | 292/350 |
| 5,236,235 | A * | 8/1993 | Gustafson et al. | ..... | 292/357 |
| 5,457,975 | A * | 10/1995 | Berger et al. | ..... | 70/370 |
| 6,102,452 | A * | 8/2000 | Liau | ..... | 292/175 |
| 6,178,794 | B1 | 1/2001 | Eller et al. | | |
| 6,425,273 | B1 * | 7/2002 | Kim et al. | ..... | 70/224 |
| 6,622,535 | B2 * | 9/2003 | Chiang et al. | ..... | 70/107 |
| 6,908,126 | B2 | 6/2005 | Senger | | |
| 6,921,116 | B2 * | 7/2005 | Humes | ..... | 292/169 |
| 7,077,437 | B2 * | 7/2006 | Huang | ..... | 292/336.3 |
| 7,082,794 | B2 * | 8/2006 | Shen et al. | ..... | 70/224 |
| 2005/0274163 | A1 * | 12/2005 | Shen et al. | ..... | 70/422 |

* cited by examiner

*Primary Examiner* — Kristina Fulton
*Assistant Examiner* — Nathan Cumar
(74) *Attorney, Agent, or Firm* — DeLio, Peterson & Curcio, LLC

(57) ABSTRACT

A roseless trim for a mortise or tubular lock includes through bolts on a bolt circle of less than one inch (25.4 mm). Spindle hubs with a curved slot allow at least one of the through bolts to pass through the spindle hubs. A tubular lock embodiment uses arms with a cutout. The arms function as through bolts when screws attach the arms to mounting plates on opposite sides of the door. Each handle is attached to a corresponding handle base with a bushing. The handle base and small diameter bolt circle cooperate to provide the appearance that the handle extends directly into the door without a rose, escutcheon or any other attachment structure at the base of the handle.

19 Claims, 18 Drawing Sheets

ROSELESS TRIM FOR ARCHITECTURAL HARDWARE

PRIORITY

This application claims priority to non-provisional application Ser. No. 12/836,206, filed Jul. 14, 2010, which claimed priority to provisional application No. 61/225,325.

BACKGROUND OF THE INVENTION

1. Field of the Invention

The present invention relates to architectural hardware installed in a door, such as a mortise lock, a tubular lock or other types of lock mechanisms, having a latchbolt retracted by a handle to unlatch the door from a doorframe. More specifically, the present invention relates to architectural hardware in which closely spaced through bolts, located on a bolt circle having a diameter of less than one inch (25.4 mm), extend through a very small opening in the face of the door.

2. Description of Related Art

Current door preparations for architectural hardware of this type require a hole through each face of the door for a spindle and usually an additional two holes on opposite sides of the central spindle hole for through bolting. Alternatively, the spindle hole may be large enough in diameter to accept the through bolts as well.

For a tubular lock (also referred to as a "bored-in" lock), a single, relatively large diameter, central spindle hole may be used. The larger hole accepts the spindle and the through bolts, which pass above and below the tubular lock assembly. The tubular lock assembly is inserted through an opening in the edge of the door.

Through bolts extend through the through bolting holes and also through the mortise lock, or above and below the tubular lock within the door. Through bolting improves the strength and security of the lock installation and may be necessary to make the architectural hardware meet the requirements of the end user and industry specifications.

For decorative purposes in both mortise locks and tubular locks, a rose or escutcheon is required to completely cover the through bolting holes as well as the spindle opening. For conventional designs, the rose or escutcheon must be relatively large in order to cover relatively widely spaced through bolts.

The through bolts generally extend between plates located on opposite faces of the door. A rose or escutcheon of sufficient size is used on each face to cover the opposed plates as well as the through bolts, the spindle holes in the door face and the mounting hardware. The large size of the rose necessary to hide these mounting components detracts from the overall appearance of the door system and is not preferred by architects.

SUMMARY OF THE INVENTION

Bearing in mind the problems and deficiencies of the prior art, it is therefore an object of the present invention to provide a roseless trim design which includes through bolts on a bolt circle of less than one inch (25.4 mm).

Still other objects and advantages of the invention will in part be obvious and will in part be apparent from the specification.

The present invention requires only a single hole through the door for both a mortise lock and a tubular lock. In a first mortise lock embodiment, the hardware consists on the secure side (outside) of the door of a handle (preferably a lever handle), a handle base (which provides the through bolting), a trim bushing and a spindle. The handle is joined to the handle base by a trim bushing which is fed into the handle base and threads into the handle. It is then locked into position by the spindle.

At least one of the through bolts passes through curved slots in spindle hubs located in the mortise lock. The curved slots allow the through bolts to remain closely spaced on a bolt circle diameter of less than one inch (25.4 mm) and close to the rotational axis of the handles without interfering with the operation of the lock. In conventional designs, such closely spaced through bolts are not possible, as they would interfere with the operation of the spindle hubs of the mortise lock.

On the unsecured side of the door, this first embodiment of the mortise lock design consists of a mounting plate (to which the through bolts connect), a handle base, a trim bushing and a spindle, as well as a setscrew. The inside mounting plate is secured in position with screws, which thread into the through bolts extending from the secure (outside) side. The unsecured side (inside) lever handle is joined to the handle base in the same way as the secured outside of the door; except that the unsecured side lever base has a setscrew hole. The unsecured inside lever assembly is then placed on the mounting plate and rotated until it engages a stop and the setscrew is tightened to complete the assembly.

For a first embodiment of the tubular lock design, the hardware on the secured side and unsecured side are identical. The mounting plate consists of two identical pieces, which are fed through the hole in the door and secured to each other by one screw on each side. The levers are joined to the lever base by a trim bushing which is fed into the lever base and threads into the lever handle. It is then locked into position by the spindle. Then the lever assembly is placed on the mounting plate and rotated until it engages a stop and the setscrews are tightened to complete the assembly.

In both cases, the through bolting bolt circle is less than one inch, which is significantly less than the standard architectural trim used currently. When the through bolting bolt circle is less than one inch (2.54 centimeters), the design may be referred to as a "roseless" trim. In the preferred design of this invention, the lever base is less than one and a half inches (3.8 centimeters), which again is significantly less than the standard architectural trim used currently.

In a second embodiment of the mortise lock design, the outside hardware consists of the outside handle, an outside handle base, an outside mounting plate, an outside bushing and an outside spindle. The outside bushing is rotatably mounted to the outside mounting plate to form an assembly with the outside mounting plate. The through bolts are connected to the mounting plate, instead of directly to the outside handle base as in the first embodiment.

The outside handle base in this second embodiment is internally threaded and is connected to external threads on the outside mounting plate. This design allows the same handle base to be used on the inside and outside, as well as on the tubular lock design. It also allows the outside handle unit to be factory assembled such that a single outside handle assembly is provided to the end user. The outside handle assembly includes the handle, the handle base, the bearing and mounting plate and the through bolts. The bearing is rotatably mounted on the mounting plate, the through bolts extend outward from the mounting plate and the handle base is threaded onto and covers the mounting plate and the heads of the through bolts.

As in the first mortise lock embodiment, the outside handle is rotatably held to the outside handle base by the outside bushing. Also, as in the first embodiment, at least one of the through bolts passes through curved slots in the inside and outside spindle hubs of the mortise lock.

On the unsecured inside of the door, the second embodiment of the mortise lock design consists of a mounting plate (to which the through bolts connect), a handle base, a trim bushing and a spindle, as well as a setscrew. The inside mounting plate, with a rotatably attached bushing, is secured in position with screws. The screws thread into the ends of the through bolts extending from the secure (outside) side. The inside handle base, which is internally threaded, is placed over the inside spindle and threaded onto the externally threaded mounting plate. The inside handle is then placed over the inside bushing and inside spindle. The setscrew on the inside handle is then tightened to hold the handle to the inside bushing to complete assembly.

The above and other objects, which will be apparent to those skilled in the art, are achieved in the present invention which, in a first aspect, is directed to a roseless trim for a mortise lock having: an outside handle base; an outside handle, rotatably attached to the outside handle base; and an outside spindle hub adapted to be rotatably mounted within the mortise lock and retract a latchbolt when rotated, the outside spindle hub having a curved slot formed therein.

The roseless trim for a mortise lock further includes an inside spindle hub adapted to be rotatably mounted within the mortise lock and retract the latchbolt when rotated, the inside spindle hub having a curved slot formed therein; an inside handle base; an inside handle, rotatably attached to the inside handle base; and a pair of through bolts, at least one through bolt extending through the curved slot in the outside spindle hub and through the curved slot in the inside spindle hub. The roseless trim for a mortise lock also includes at least one mounting plate, the through bolts being connected to the at least one mounting plate on a through bolt mounting circle having a diameter of less than one inch (25.4 mm), the through bolts extending through the mortise lock between opposite sides of a door and acting to secure the at least one mounting plate against rotation.

The inside and outside handle bases are secured against rotation by the through bolts and by the at least one mounting plate. The inside and outside handle bases have a size sufficient to cover the through bolts to prevent the through bolts from being seen when installed.

In another aspect of one embodiment, the through bolts connect between the outside handle base and the at least one mounting plate. The roseless trim for a mortise lock further includes an outside spindle extending between the outside spindle hub and the outside handle; an inside spindle extending between the inside spindle hub and the inside handle; an outside bushing extending into the outside handle base and receiving the outside spindle; and an inside bushing extending into the inside handle base and receiving the inside spindle.

In yet another aspect the outside bushing is attached to the outside handle and acts to hold the outside handle to the outside handle base while permitting rotation of the outside handle relative to the outside handle base. In this aspect, the outside bushing is preferably threadedly attached to the outside handle.

In still another aspect, the outside bushing includes a central opening for receiving the outside spindle; the central opening in the outside bushing is shaped to prevent the outside bushing from rotating relative to the outside spindle; the outside spindle locks the outside handle base to the outside handle by preventing rotation of the outside bushing relative to the outside handle when the outside spindle is inserted through the outside bushing into the outside handle; and the outside handle base is held in place by connection between the outside handle base and the through bolts.

In one embodiment, the inside bushing is attached to the inside handle and acts to hold the inside handle to the inside handle base while permitting rotation of the inside handle relative to the inside handle base.

In a second embodiment of the invention, there are two mounting plates, one on the inside and one on the outside and the through bolts are connected between the inside mounting plate and the outside mounting plate. In the preferred design of this embodiment, the outside bushing is attached to the outside handle and acts to hold the outside handle to the outside handle base and to the outside mounting plate while permitting rotation of the outside handle relative to the outside handle base and the outside mounting plate. The inside bushing is rotatably connected to the inside mounting plate; and the inside bushing is non-rotatably connected to the inside handle by a setscrew.

In still another aspect of the roseless trim for a mortise lock, the outside bushing is threadedly attached to the outside handle; the outside bushing includes a central opening for receiving the outside spindle; the central opening in the outside bushing is shaped to prevent the outside bushing from rotating relative to the outside spindle; and the outside spindle locks the outside handle base to the outside handle by preventing rotation of the outside bushing relative to the outside handle when the outside spindle is inserted through the outside bushing into the outside handle.

The present invention is also directed to a spindle hub including: a spindle hub body having an outside perimeter shaped to retract a latchbolt of a mortise lock when the spindle hub is rotated; the spindle hub body including a central opening shaped to non-rotatably engage a spindle extending into the central opening, the central opening defining a rotational axis for the spindle hub body; and the spindle hub body further including a second opening substantially offset from the rotational axis of the spindle hub body and shaped to allow a through bolt to pass through the second opening without interfering with rotation of the spindle hub body.

The outside perimeter of the spindle hub is preferably shaped as an arm to contact and retract the latchbolt when the spindle hub is rotated. The spindle hub includes a curved slot having a curved centerline defined by an arc of a circle and a center of curvature located at the rotational axis of the spindle hub.

The circle defining the curved centerline of the second opening is a through bolt mounting circle having a diameter of less than one inch (25.4 mm) to allow for a roseless installation.

In still another aspect, the curved slot has a minimized width defined by a width of a through bolt passing through the second opening to provide clearance between the spindle hub body and the through bolt. This allows rotation of the spindle hub relative to the through bolt. The curved slot has a minimized length sufficient to allow rotation of the spindle hub body to retract the latchbolt of the mortise lock. The minimized length and width of the curved slot act to minimize loss of material and loss of structural strength of the spindle hub.

In still another aspect of the invention, a roseless trim for a tubular lock includes: an outside handle base; an outside handle; an outside spindle; an outside bushing extending into the outside handle base and receiving the outside spindle; an outside mounting plate; an inside mounting plate; a pair of arms, one arm extending above the bored in lock and one arm extending below the bored in lock, each arm having a curved outside surface and a cut away portion receiving the bored in lock, the arms being connected to the outside mounting plate at one end and to the inside mounting plate at the other end with bolts on a bolting circle having a diameter of less than one inch (25.4 mm); an inside spindle; an inside handle base; and an inside handle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 22 is a side elevational view of the arm. FIGS. 21 and 23 are end views showing threaded openings in the ends of the arm in FIG. 22. FIG. 20 is a detail view, at an enlarged scale, of the dashed circle area in FIG. 22.

DESCRIPTION OF THE PREFERRED EMBODIMENT(S)

In describing the preferred embodiment of the present invention, reference will be made herein to FIGS. 1-52 of the drawings in which like numerals refer to like features of the invention.

Figure 1:
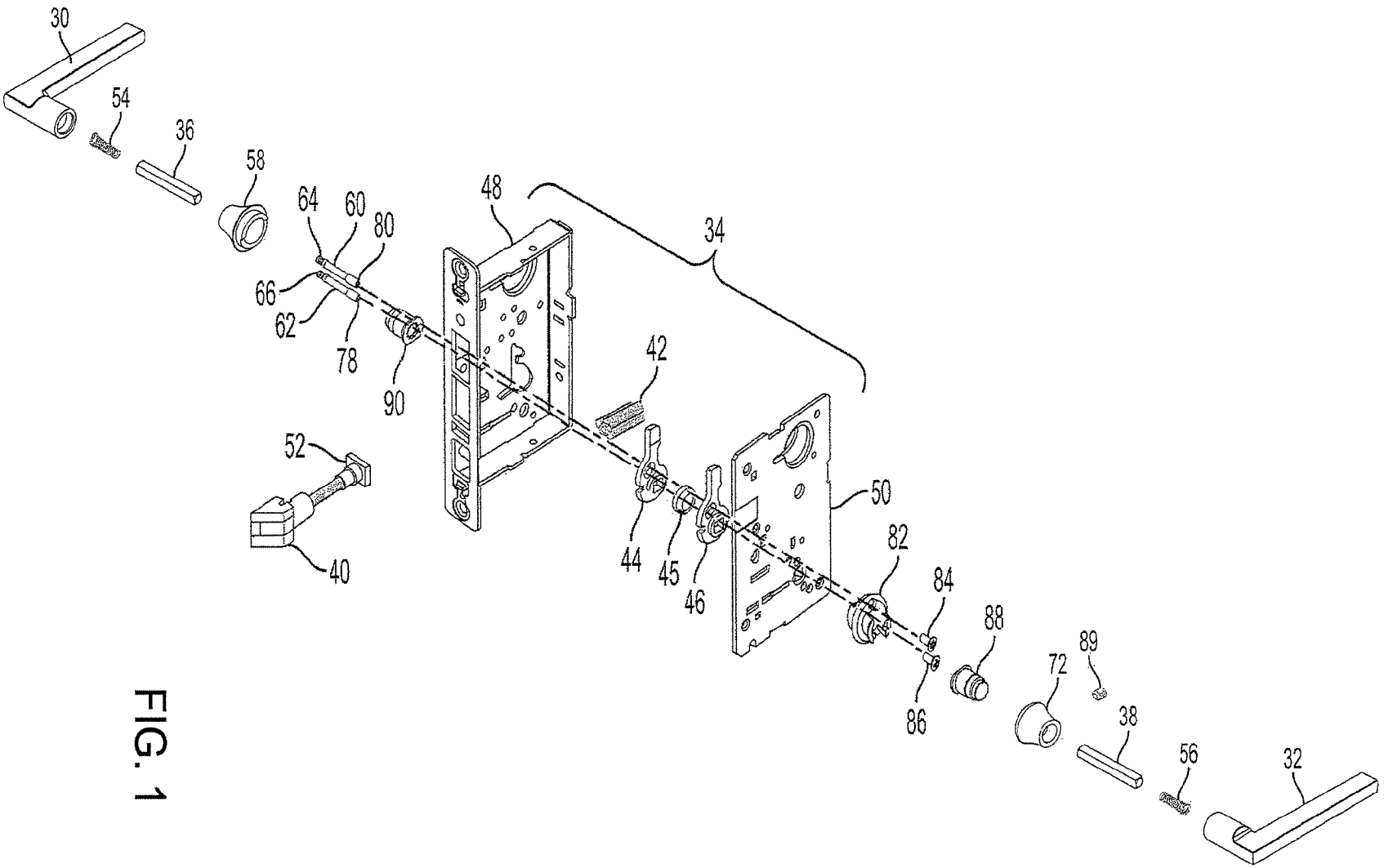
FIG. 1 is an exploded perspective view of a first embodiment of the roseless trim for a mortise lock. Components of the mortise lock that are conventional are not shown.
Figure 3:
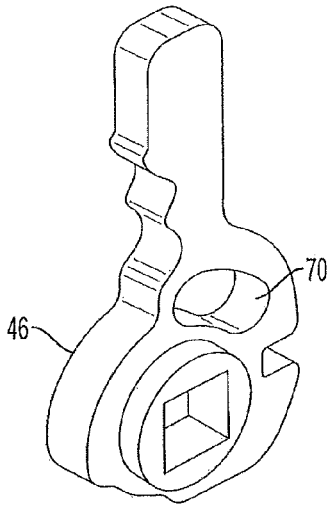
FIGS. 3 and 4 are perspective views of the mortise lock spindle hubs with slots seen in FIG. 1. The spindle hubs are usable with all embodiments of the roseless trim for a mortise lock. The slots allow close spacing of the through bolts.
Figure 4:
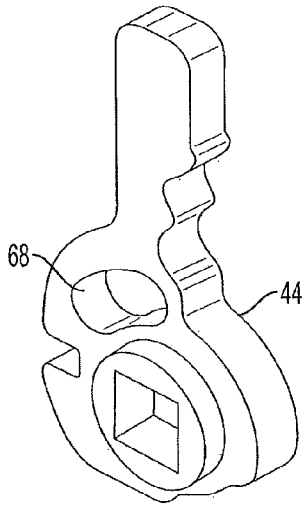

Referring to FIG. 1, an outside handle 30 and an inside handle 32 engage the mortise lock 34 through spindles 36 and 38. The mortise lock 34 includes a latchbolt 40, a latchbolt spring 42, and a pair of spindle hubs 44, 46 (see FIGS. 3 and 4). A bushing 45 is preferably located between the spindle hubs.

The latchbolt spring 42 biases the latchbolt 40 towards the outward position to engage a strike in a doorframe. The spindle hubs 44, 46 are located inside the mortise case 48 with the latchbolt spring and other components not shown. The spindle hubs are each provided with a square opening in a conventional manner that engages with the ends of spindles 36 and 38 so that they can be separately turned. The latchbolt case includes a cover 50 and when fully assembled the mortise lock is mortised into a door in a conventional manner (see FIG. 48, which shows the door in connection with a second embodiment of the invention).

Outside spindle 36 engages the outside spindle hub 44 while the inside spindle 38 engages inside spindle hub 46. When the handle is rotated, provided that the locking mechanism of the mortise lock (not shown) permits, the corresponding spindle hub rotates to retract the latchbolt 40 by compressing spring 42. The spindle hub includes a body having an outside perimeter shaped to contact the tail 52 of the latchbolt 40 to push it away from the door strike and unlatch the door.

The outside handle 30 receives the outside spindle 36 and spring 54 urges the outside spindle 36 into engaging contact with the square central hole in the outside spindle hub 44. In a similar manner, inside spindle spring 56 acts between the inside handle 32 and the inside spindle 38 to urge the inside spindle into engaging contact with the inside spindle hub 46 located inside the mortise lock 34.

The invention further includes an outside handle base 58 which receives a pair of through bolts 60, 62, having corresponding threading ends 64, 66, threaded into the outside handle base 58. The through bolts 60, 62 extend through the mortise lock and through slots 68 and 70 formed in the spindle hubs 44 and 46 (see FIGS. 3 and 4).

The through bolts 60 and 62 are very close to the centerline rotational axis of the spindles 36 and 38 and, accordingly, the curved slots 68, 70 in the spindle hubs 44, 46 permit the spindle hubs to rotate and retract the latchbolt 40 without interference from the through bolts 60, 62.

The term "through bolt" when used herein refers to structures that extend between opposite faces of a door and use a threaded connection to clamp the door and provide a secure attachment structure extending between the opposed faces of the door. They may include actual bolts with threads at one end and a head at the opposite ends. However, in the first embodiment of the mortise lock design, they are similar to studs in that they have an external thread at one end and an internal thread at the other end that receives a screw.

In a second embodiment of the mortise lock design, the through bolts have an enlarged head at one end and an internal thread at the other end. The internal thread receives a screw as in the first mortise lock embodiment. In the tubular lock embodiment, the through bolts are specially shaped arms with two internally threaded openings at the opposite ends that receive screws. The term "through bolt" is used for all of these structures and for other structures that extend between opposite sides of the door and perform the functions that are commonly performed by through bolts in conventional designs.

The close spacing of the through bolts 60, 62 allows a very small diameter opening in the door to be used for the spindles and through bolts. Accordingly, a conventional rose is not required to surround the area outward from the handle bases 58 and 72. The term "roseless" is used herein when the through bolts are located on a bolt circle that is less than one inch (25.4 mm) in diameter.

This small diameter allows the through bolts to be covered by the base of each handle and provides the "roseless" appearance to the lock mechanism. The handle and base of the handle appear to extend directly into the door surface, without requiring a conventional large escutcheon or "rose" at the base of the handle.

The outside handle base 58 has a diameter just slightly larger than the hole in the door that receives the spindles and through bolts.

Figure 2:
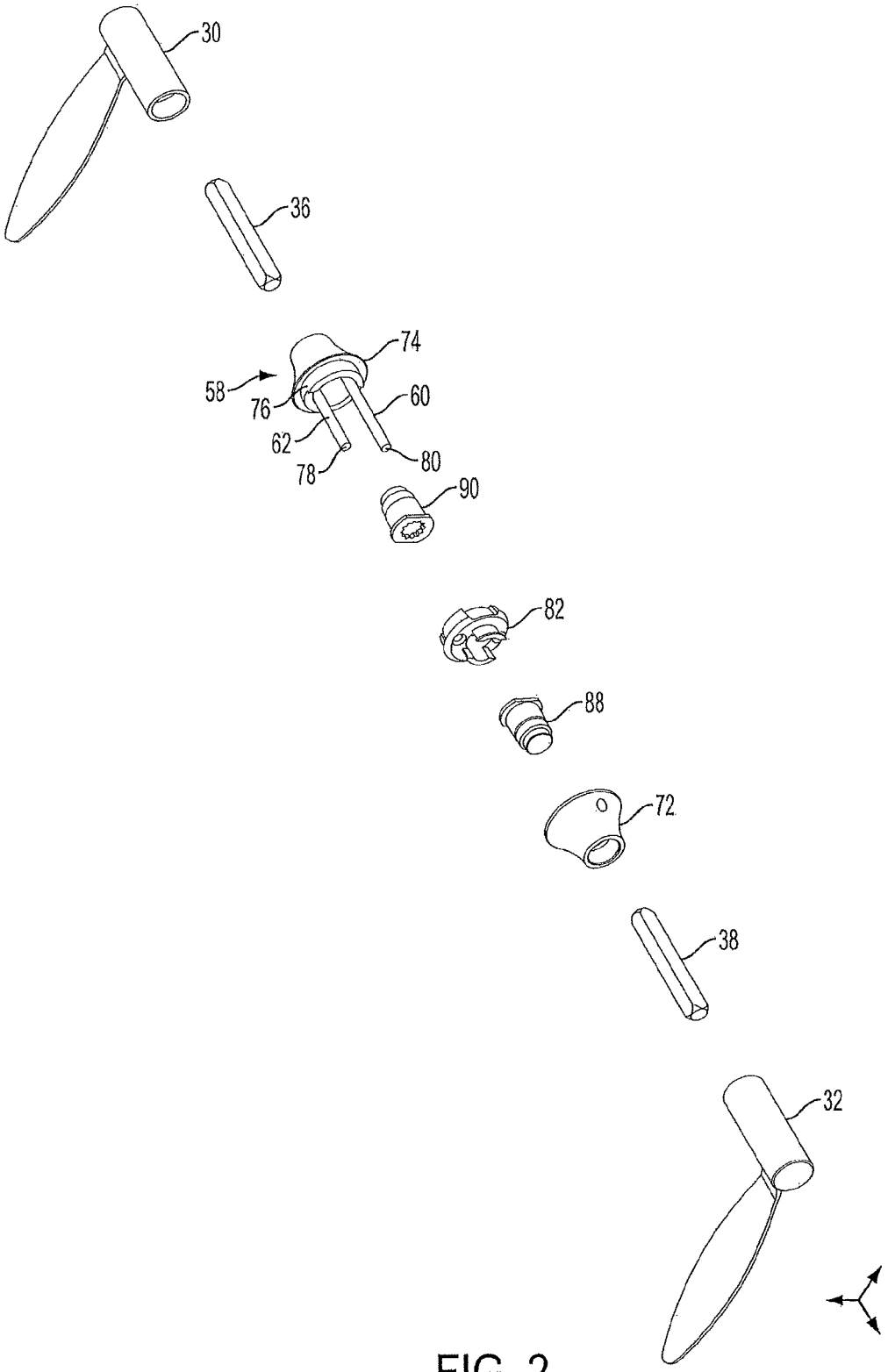
FIG. 2 is an exploded perspective view of components of the roseless trim for a mortise lock seen in FIG. 1, drawn at an enlarged scale.

Referring to FIG. 2, further details of the first embodiment of the roseless trim for a mortise lock can be seen. The spindle hubs have been omitted, but are shown in detail in FIGS. 3 and 4. A lip 74 on the outside handle base 58 fairs smoothly in the direction toward the outside handle 30 and forms a step in its base 76 that fits inside the opening created in the door.

In this first embodiment, the through bolts 60 and 62, are attached directly to the outside handle base 58. In the second embodiment (see FIG. 49), they are attached to an outside mounting plate 197 and the handle base is attached to the mounting plate. In both embodiments, the through bolts include threaded openings at their ends 78 and 80 (FIG. 2) and 178, 180 in FIG. 49. Referring to FIG. 1, showing the first embodiment, a mounting plate 82 is placed on the inside of the door and through bolt screws 84 and 86 attach to the threaded open ends 78 and 80 of the through bolts 62 and 60.

The door is assembled by inserting the mortise lock 34 into the mortise lock opening and attaching the through bolts which extend through the mortise lock to the outside base 58 followed by attaching the screws 84 and 86 through the mounting plate 82 to hold the outside handle 30 securely to the door. The mounting plate 82 is covered by the inside handle base 72.

Figure 32:
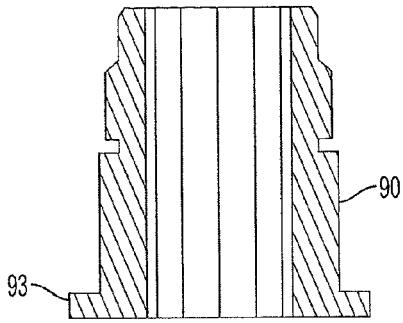
Figure 31:
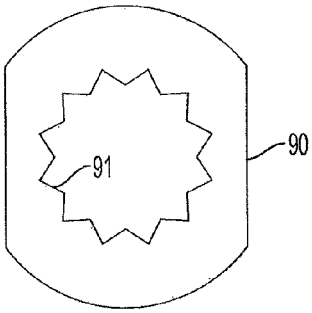
Figure 33:
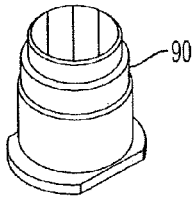

Bushings 88 and 90 are provided on opposite sides of the door. Outside handle base 58 is held to the outside handle 30 by the outside bushing 90, which is externally threaded and threads into internal threads on the handle 30. As the bushing is threaded into the handle, it traps the outside handle base with lip 93 (see FIG. 32).

This produces an outside handle assembly with the outside handle base rotatably held to the outside handle. The through bolts extend outward from the handle base around the outside bushing. This complete outside handle assembly may be pre-assembled at the factory.

To prevent the bushing from unthreading, the central opening 91 in the bushing (see FIG. 31) is shaped to engage the outside spindle and prevent the spindle from rotating relative to the bushing (see generally FIGS. 30-33). The outside handle 30 non-rotatably engages the outside spindle 36. When the outside spindle is inserted through the opening 91 in the outside bushing, it rotationally locks the outside bushing 90 relative to the outside handle and prevents unthreading of the outside bushing, thereby holding the outside handle base to the outside handle, while permitting relative rotation therebetween.

The inside handle base 72 operates in a similar manner as described above, except that setscrew 89 is used to lock the inside handle base 72 to the inside mounting plate 82. As described above, with the mortise lock installed, the outside handle assembly is positioned, with the through bolts extending therefrom. At least one of the two through bolts extends through the curved slots in the inside and outside spindle hubs.

Figure 17:
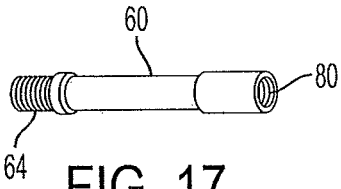

The two through bolts extend to the inside door surface and the inside mounting plate is installed with the two screws 84 and 86, which thread into the internally threaded ends 78, 80 of the through bolts (see FIG. 17). This clamps the inside mounting plate to the outside handle base via the through bolts. In this first embodiment, the inside spindle bearing 88 is externally threaded and holds the inside handle base to the inside handle as described for the outside handle.

With the inside spindle in place, the inside handle base (along with the inside bearing and inside handle) is positioned. The inside handle assembly is then rotated so that the inside handle base engage the inside mounting plate. The setscrew 89 extends through the inside handle base and engages the inside mounting plate to prevent removal of the inside handle assembly.

Figure 5:
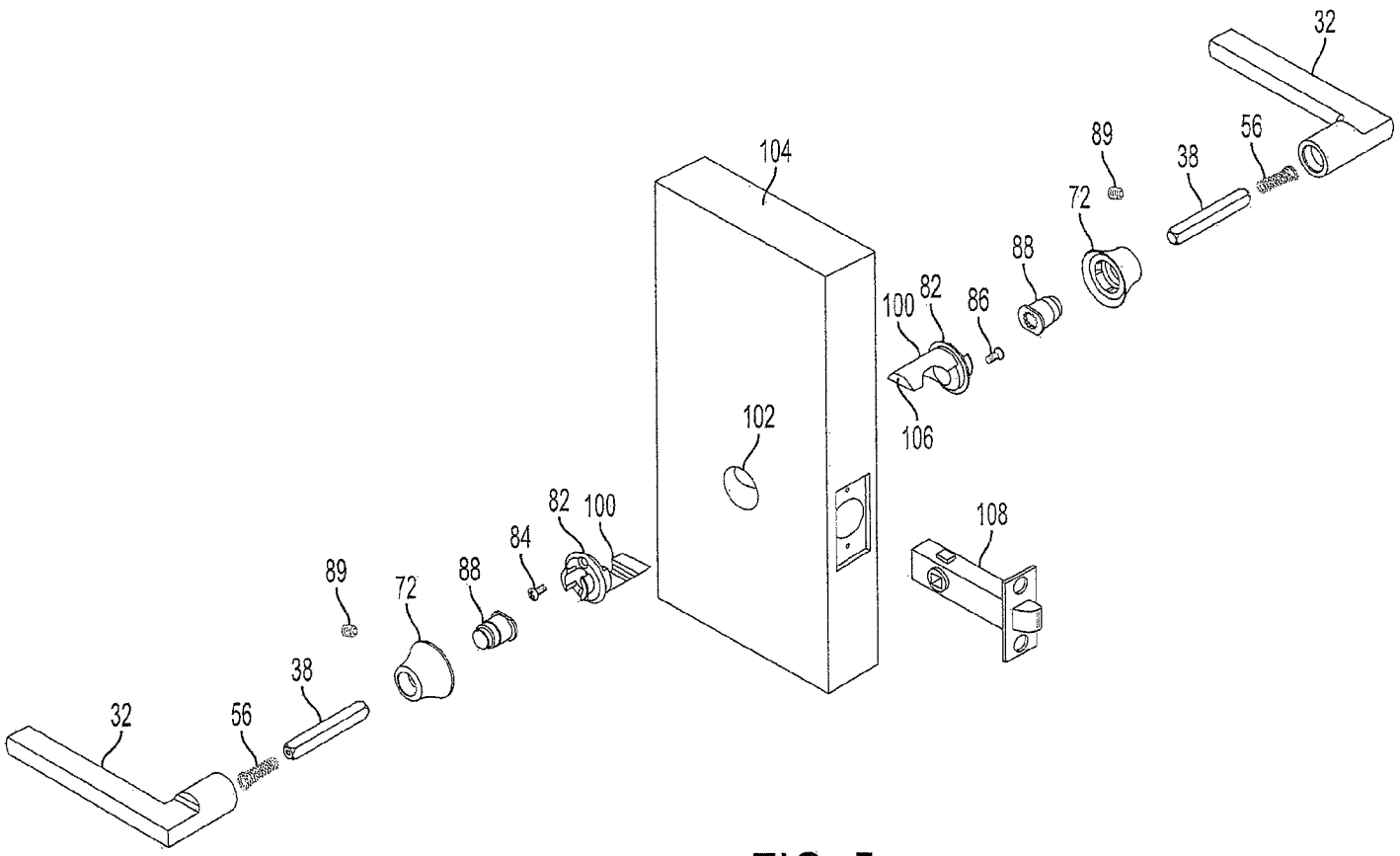
FIG. 5 is an exploded perspective view of a first embodiment of the roseless trim for a tubular lock.
Figure 6:
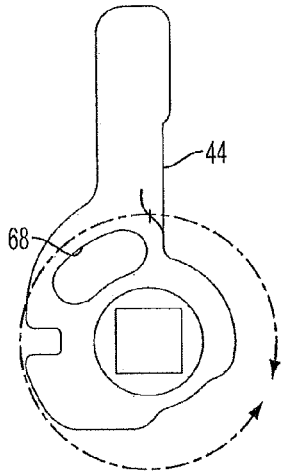
FIGS. 6-9 show details of the spindle hubs seen in FIGS. 3 and 4.
Figure 7:
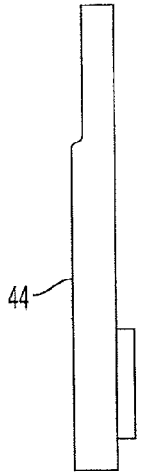
Figure 8:
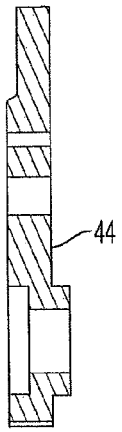
Figure 9:
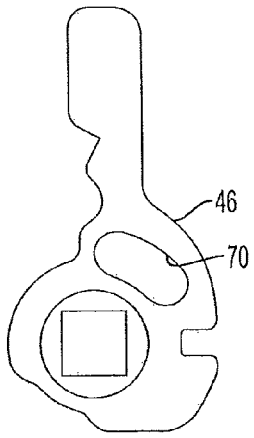
Figure 10:
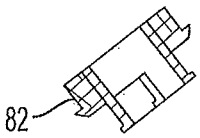
FIGS. 10-14 show details of the mounting plates seen in FIGS. 1, 2 and 5.
Figure 11:
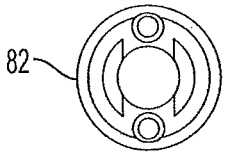
Figure 12:
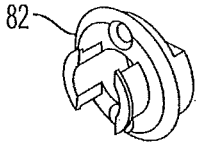
Figure 13:
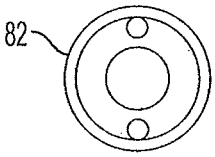
Figure 14:
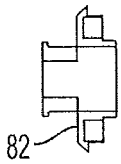

FIG. 5 shows the first tubular lock embodiment of this invention. For the tubular lock, the hardware on the secured side and unsecured side are identical. All of the components on the inside of the door seen in FIG. 1 are used for both sides of the assembly seen in FIG. 5.

Figure 21:
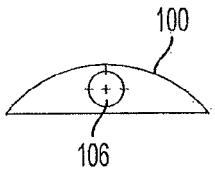
Figure 22:
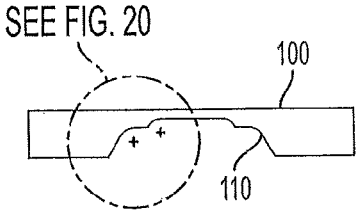
Figure 23:
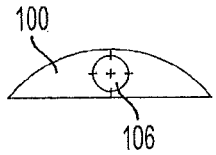
Figure 24:
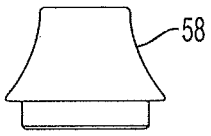
FIGS. 24-29 show details of the outside handle base seen in FIGS. 1, 2 and 5.
Figure 25:
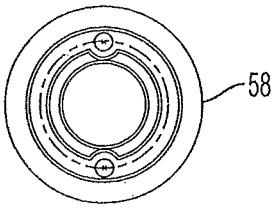
Figure 26:
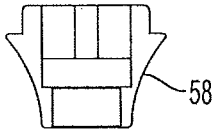
Figure 27:
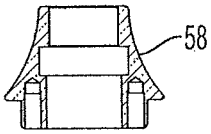
Figure 28:
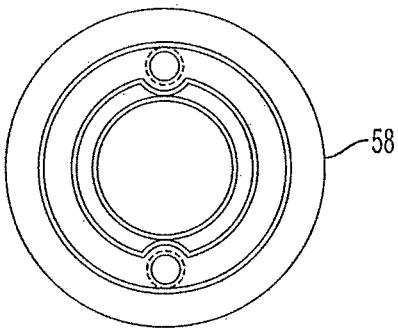

The handles 32 include spindle springs 56 and spindles 38. The handle bases 72 are attached to the handles by threading the bushings 88 as described above. This assembly is then secured against unthreading when the spindle is inserted. In the tubular design shown in this first embodiment, two mounting plates are used, but instead of using the through bolts described above for the mortise lock, the through bolting is achieved by connecting the two mounting plates together with arms 100 (see FIGS. 20-23). The arms act as the through bolts and have a curved upper surface that matches the curvature of the spindle hole 102 in the door 104 (See FIGS. 21 and 23). Each arm has two threaded openings 106, one at each end. Four screws, two for each mounting plate (screws 84 and 86) are used.

When installed, one arm passes above the tubular lock 108 and one arm passes underneath. The arms, with one mounting plate attached to each by one of the screws, are inserted from opposite sides into the opening 102 and the second mounting screw is attached. The tubular lock is then inserted between the arms. A cutout is provided in each arm at 110 (See FIG. 22). This cutout provides space so that the tubular lock fits between the arms, while allowing the screws 84, 86 to be very close to one another on a bolt circle that is less than one inch (25.4 mm).

The arms grab the top and bottom of the tubular lock providing a secure mounting. The lever handle assembly comprising the handles 32, the spindle, the handle base and the bushing is then placed on the corresponding mounting plate 82 and rotated to engage a stop. The setscrew 89 is then tightened to complete the assembly. This procedure is completed for each side.

In the tubular lock design, the tubular lock is inserted into the edge of the door. In order to reduce the spacing between through bolts to produce the small "roseless" design of this invention, through bolts would have to pass through the tubular lock assembly. This would interfere with the operation of the lock assembly. In the mortise lock, this interference is avoided by using slots in the spindle hubs.

In the tubular lock design of FIG. 5, this interference with the lock mechanism is avoided by passing the force between the mounting plates up and over, as well as below and under the lock mechanism with the arms seen in FIGS. 20-23. The arms 100 with one of the screws 84, 86 threaded into its end acts as the through bolts in a manner similar to the through bolts of FIGS. 1 and 2.

FIGS. 6-44, show additional details of the components of the first embodiment of the invention. FIGS. 6-9 show the spindle hubs of the present invention. with the curved slots that allow the close spacing of through bolts required for this "roseless" trim design. The spindle hubs have a curved slot with a curved centerline defined by an arc of a circle. The center of curvature of that circle (the through bolt "bolt circle") is located at the rotational axis of the spindles and the spindle hubs.

Figure 15:
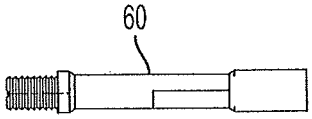
FIGS. 15-17 show details of the through bolts seen in FIGS. 1 and 2.
Figure 16:
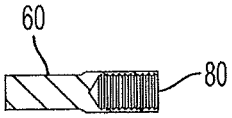

FIGS. 10-14 show the first embodiment for the inside mounting plate 82. FIGS. 15-17 show the first embodiment for the through bolts. External threads 64 engage the outside handle base, while internal threads 80 receive the screws that hold the mounting plate to the through bolts.

Figure 18:
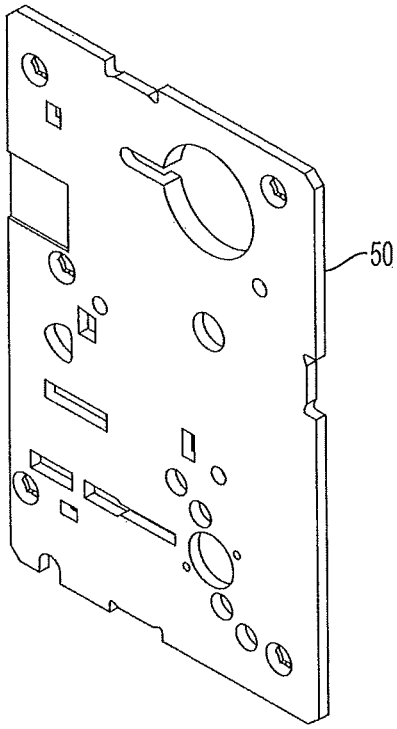
FIGS. 18-19 show details of the mortise lock case cover seen in FIG. 1.
Figure 19:
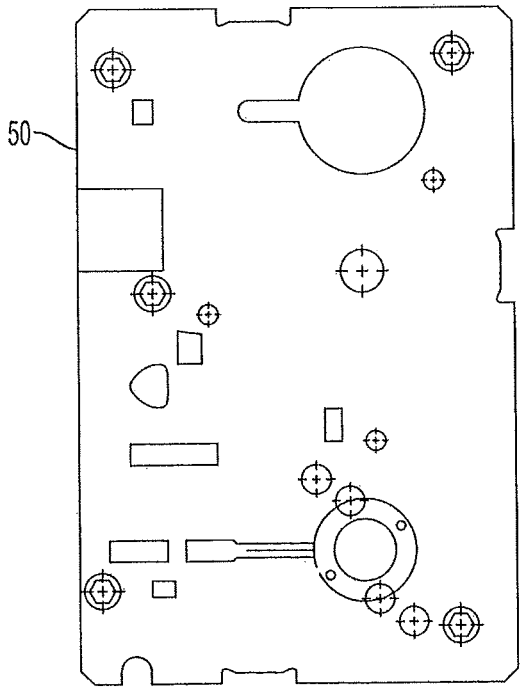
Figure 20:
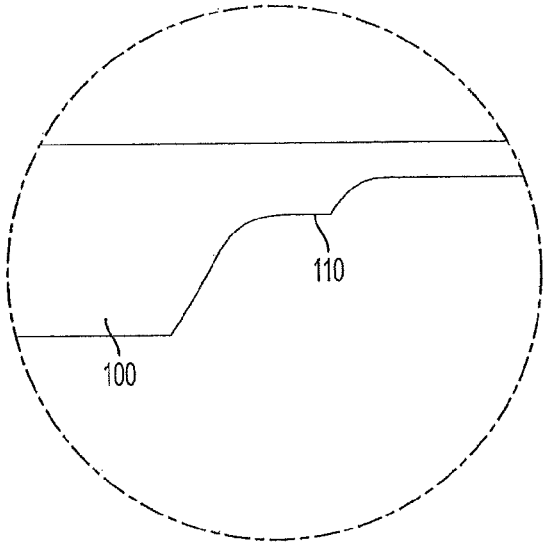
FIGS. 20-23 show details of the arms in FIG. 5 that pass above and below the tubular lock assembly.

FIGS. 18 and 19 show the face plate for a typical mortise lock of the type seen in FIG. 1 with closely spaced holes, separated by a distance of less than one inch (25.4 mm) as needed to allow passage of the closely spaced through bolts for the roseless trim of this invention.

FIGS. 20-23 show details of the through bolts used in the first embodiment of the roseless trim for a tubular or bored-in lock. The tubular lock is installed through a relatively small opening in the edge of the door through which the latchbolt of a conventional cylindrical lock is normally installed. The through bolts in FIGS. 20-23 are specially shaped to pass over and above the tubular lock so that the size of the opening in the face of the door can be reduced as compared to designs that use an escutcheon or rose. This allows the "roseless" design of the present invention.

Figure 29:
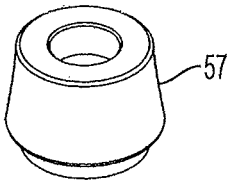
Figure 30:
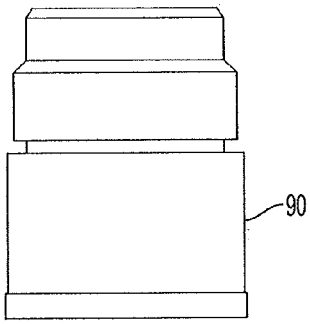
FIGS. 30-33 show details of the bushings seen in FIGS. 1, 2 and 5.

FIGS. 24-29 generally show the outside handle base used with the first embodiment of this invention. FIG. 29 shows an alternative shape 57 for the handle base, which illustrates how differently shaped handles can be used with an appropriately shaped handle base.

Figure 34:
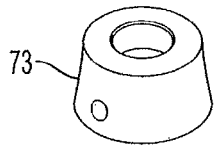
FIGS. 34-42 show details of the inside handle base seen in FIGS. 1, 2 and 5.
Figure 35:
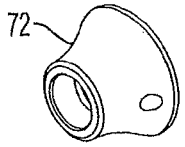
Figure 36:
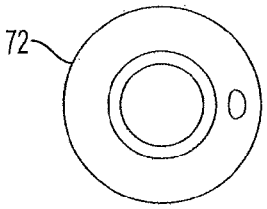
Figure 37:
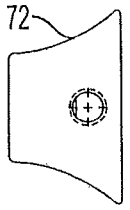
Figure 38:
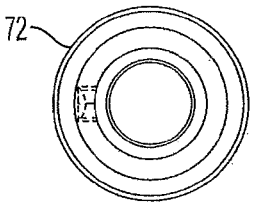
Figure 39:
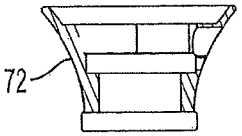
Figure 40:
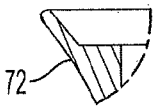
Figure 41:
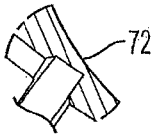
Figure 42:
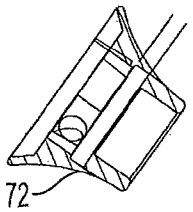

FIGS. 30-33 show the bushing 90 used in the first embodiment of this invention. FIG. 34 shows an alternative inside handle base design 73, similar to the alternative outside handle base in FIG. 29. FIGS. 35-42 show details of the inside handle base 72 which rotationally connects to the inside mounting plate and is locked in position with setscrew 89.

Figure 43:
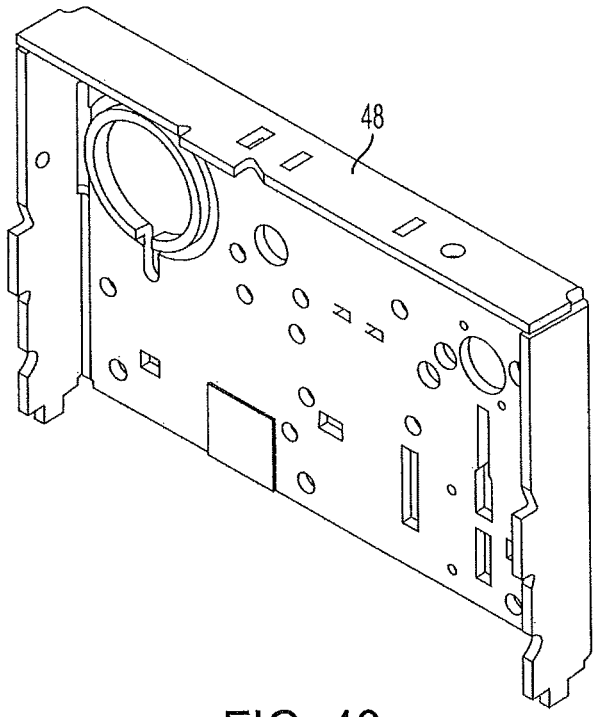
FIGS. 43-44 show details of the mortise lock case seen in FIG. 1.
Figure 44:
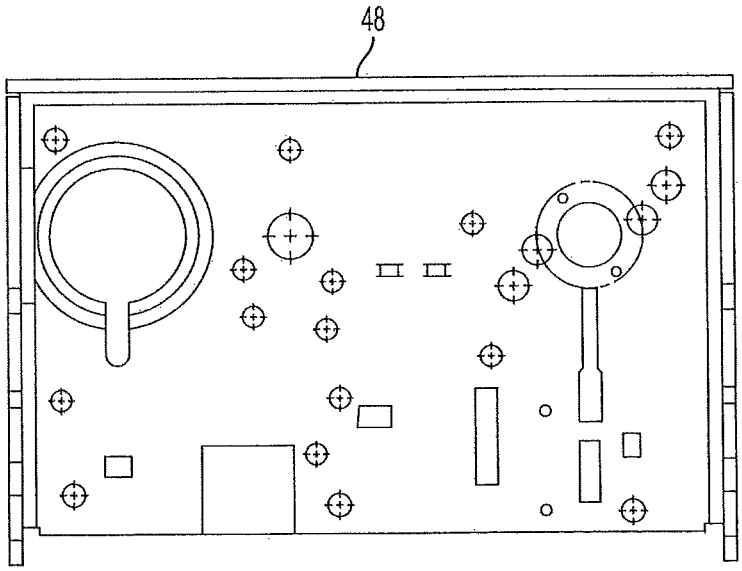

FIGS. 43 and 44 show the mortise lock case for the mortise lock seen in FIG. 1, which is usable with the mortise lock face plate seen in FIGS. 18 and 19. The face plate and case have closely spaced holes, separated by a distance of less than one inch (25.4 mm) as needed to allow passage of the closely spaced through bolts for the roseless trim of this invention.

Figure 45:
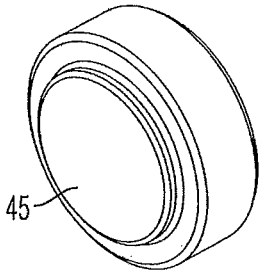
FIGS. 45-47 show details of a bushing between the spindle hubs seen in FIG. 1.
Figure 46:
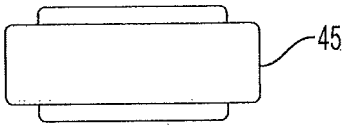
Figure 47:
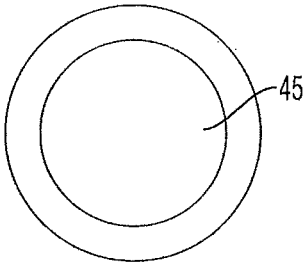

FIGS. 45-47 show bushing 45 from FIG. 1, which is preferably located between the inside and outside spindle hubs.

Figure 48:
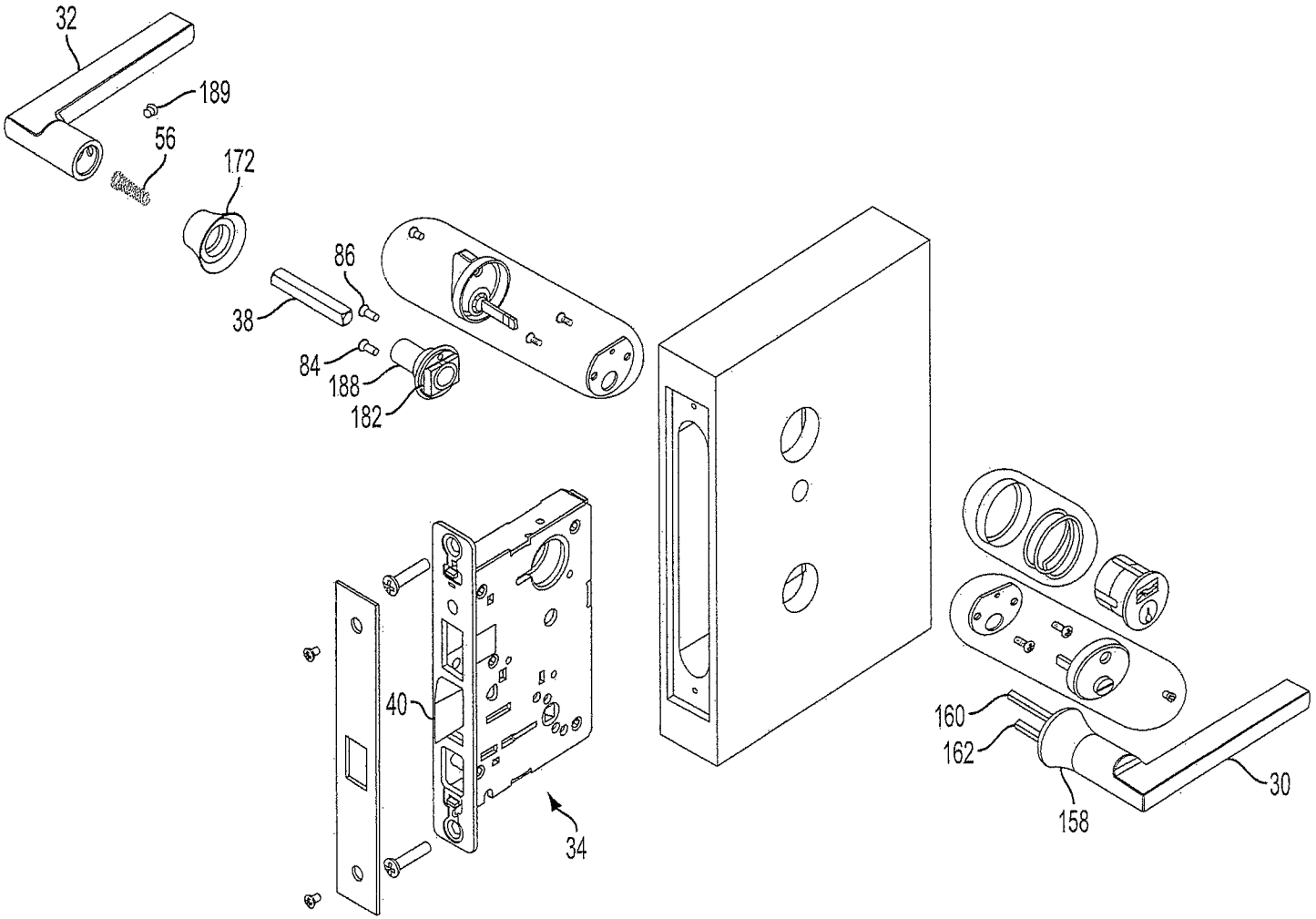
FIG. 48 is an exploded perspective view showing a second embodiment of the roseless trim for a mortise lock.
Figure 49:
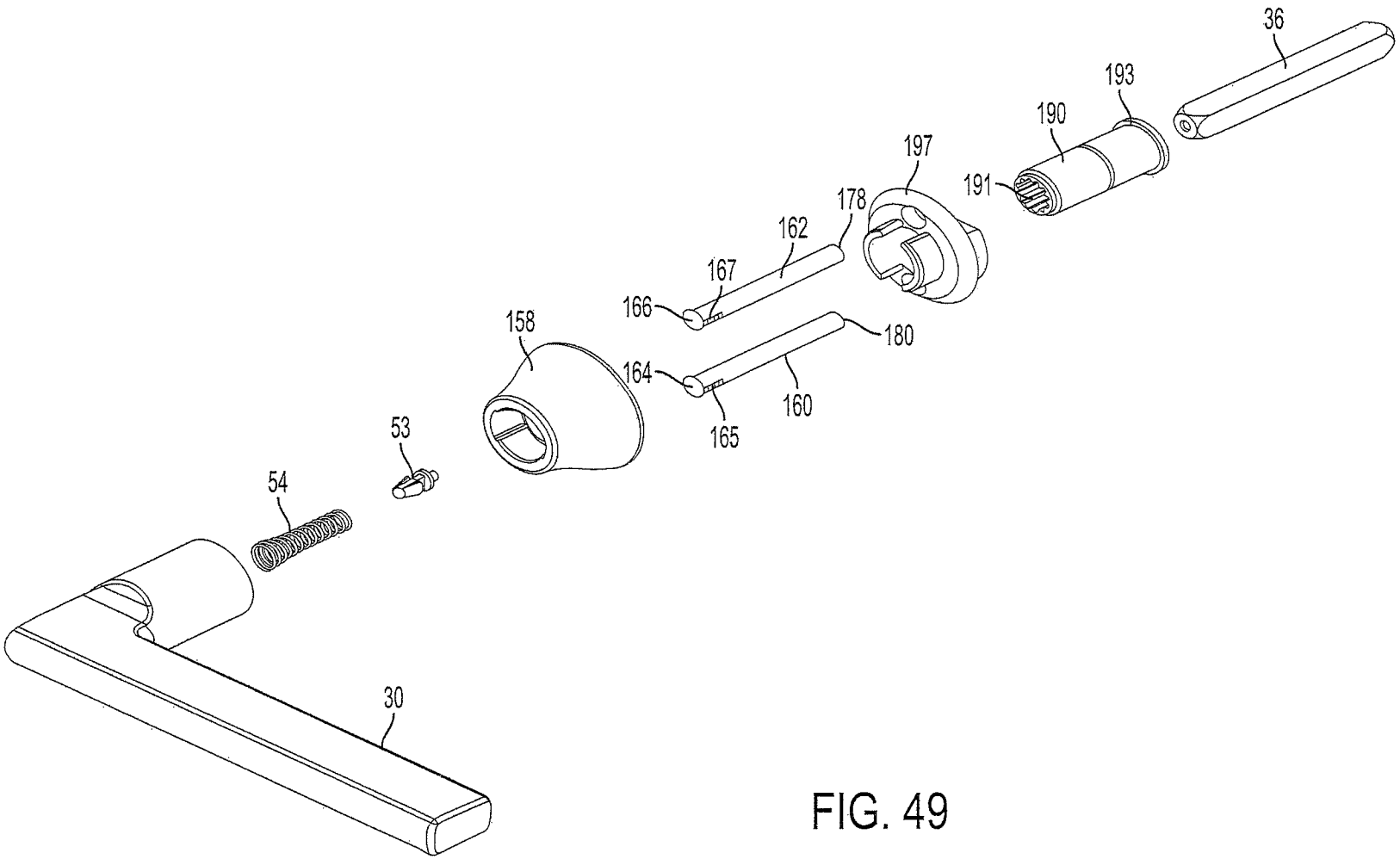
FIG. 49 is an exploded perspective view showing the outside trim assembly of the second embodiment of the roseless trim for a mortise lock seen in FIG. 48.
Figures 50, 52:
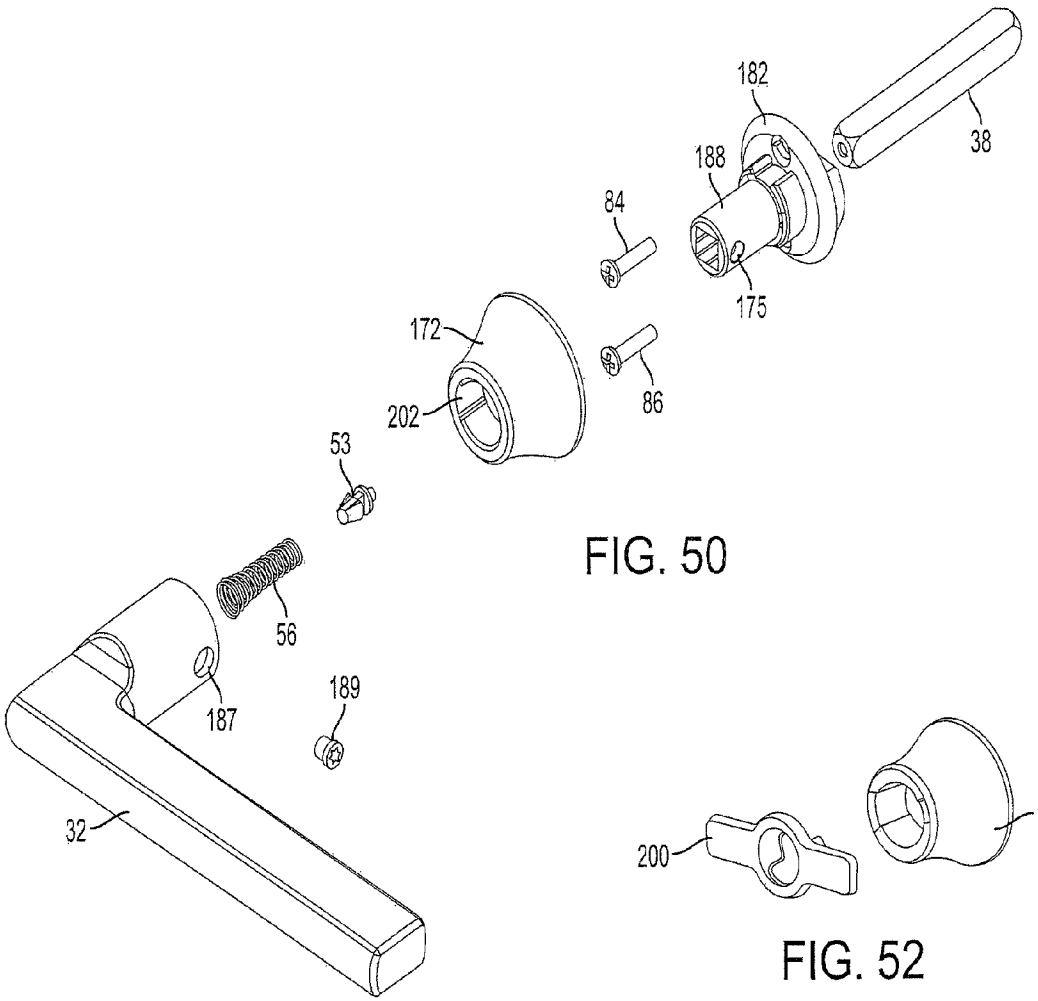
FIG. 50 is an exploded perspective view showing the inside trim assembly of the second embodiment of the roseless trim for a mortise lock seen in FIG. 48.
FIG. 52 is a perspective view showing a tool for installing the inside handle base (and the handle base) of the second embodiment of the roseless trim for a mortise lock.

FIGS. 48-50 show a second embodiment of the roseless trim for a mortise lock. In this design, the outside handle 30 is provided with a redesigned outside handle base 158 and an outside mounting plate 197. The through bolts 160, 162 are shaped as studs and have enlarged heads 164, 166 with anti-rotation ridges 165, 167 that hold the through bolts into the outside mounting plate 197. The features 165, 167 prevent the through bolts from rotating relative to the mounting plate 197 when screws are connected to the internally threaded ends 178, 180 of the through bolts.

This design allows the same handle base to be used for both the inside handle base 172 (see FIG. 50) and the outside handle base 158 (see FIG. 49). The outside spindle bushing 190 is externally threaded and includes a star shaped central opening 191 as described in connection with the first embodiment and FIG. 31.

The central opening 191 in the outside spindle bushing 190 prevents the outside spindle bushing from unthreading from internally threaded handle 30 when the outside spindle 36 is inserted. Lip 193 on the outside spindle holds the outside mounting plate 197 and the through bolts to the outside handle 30. The outside mounting plate 197 is externally threaded. The outside handle base 158 is internally threaded and engages the external threads on the mounting plate.

The outside handle base covers the outside mounting plate and the heads of the through bolts. The complete outside handle may be pre-assembled at the factory to form the assembly seen in FIG. 48 Spindle spring 54 is held into the handle 30 with spindle spring clip 53.

FIG. 50 shows the inside handle components. With the mortise lock 34 installed in the door, the outside handle assembly is positioned, with the through bolts extending into the door and through the mortise lock. At least one of the two through bolts 16, 162 will extend through the slots 68, 70 in the inside and outside spindle hubs 44, 46.

The inside spindle 38 is inserted into the inside spindle hub and the inside mounting plate 182 is placed in position and aligned relative to the ends of the through bolts. The inside mounting plate 182 has the inside spindle bearing 188 attached to it so that the bearing can rotate relative to the mounting plate. Preferably a C-clip (not shown) is used.

The screws 84 and 86 are threaded into the internally threaded ends 178, 180 of the through bolts to clamp the inside mounting plate in position. The inside handle base 172, which is internally threaded, is threaded onto the externally threaded inside mounting plate 182. Preferably, a tool 200 (see FIG. 52) is used to tighten the inside handle base onto the inside mounting plate.

The tool 200 fits into and engages the inside of the handle base 172 as shown in FIG. 52. The tool 200 is shaped with external projections that engage slots 202 in the interior of the inside handle base 172. The exterior of the installation tool 200 is shaped to allow the installer to rotate the tool and apply sufficient torque to the inside handle base to thread it tightly onto the inside mounting plate.

The inside handle 32 is then slipped over the inside spindle and the inside spindle bearing. Unlike the outside spindle bearing, the inside spindle bearing is not externally threaded. Setscrew 189 is then threaded into opening 187 in the inside handle and engages opening 175 on the inside spindle bearing. Assembly is now complete.

Figure 51:
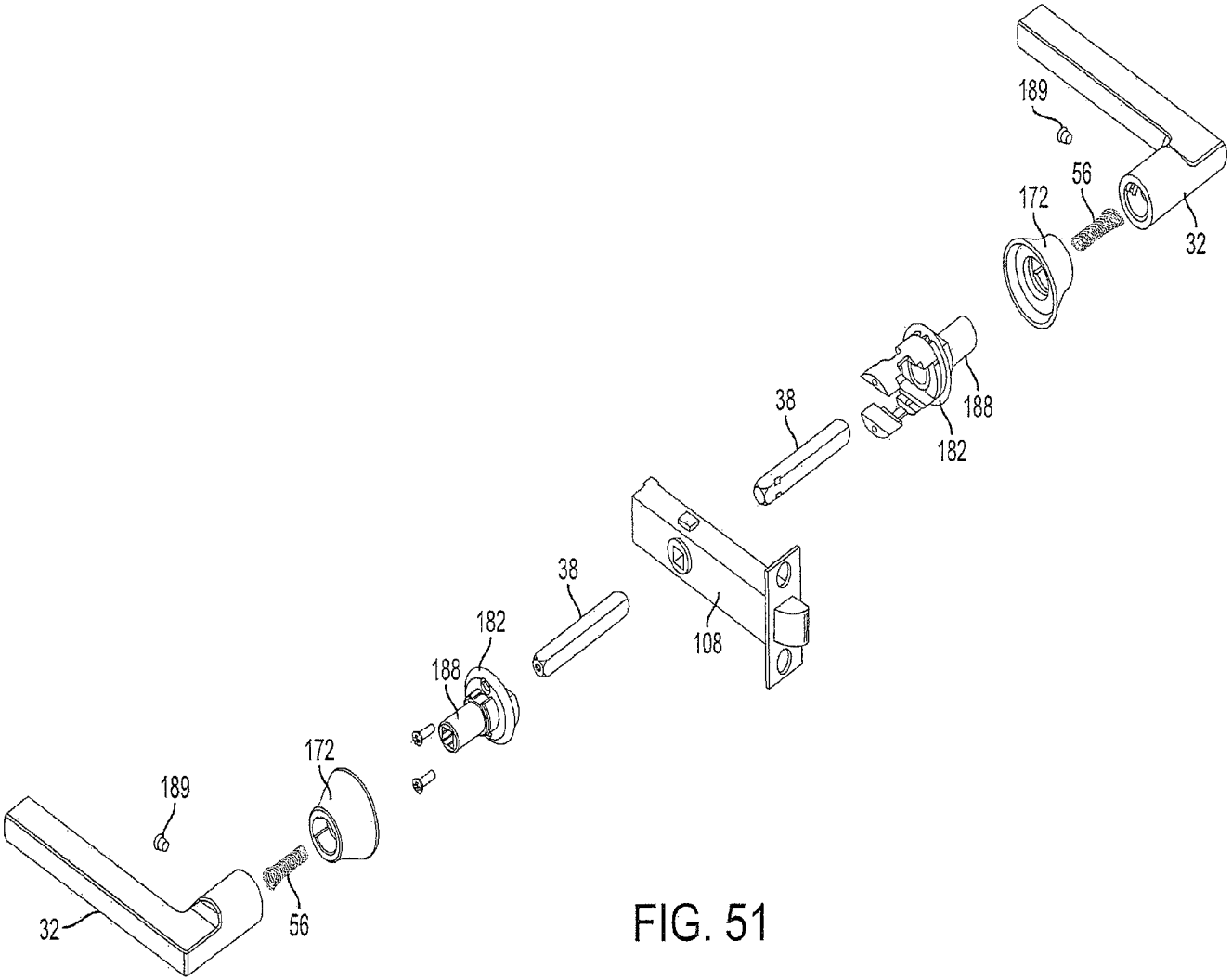
FIG. 51 is an exploded perspective view of a second embodiment of the roseless trim for a tubular lock.

FIG. 51 shows a second embodiment of the roseless trim for a tubular lock. As in the first embodiment, the hardware on the secured outside and unsecured inside are identical. All of the components on the inside of the door seen in FIG. 50 are used for both sides of the assembly seen in FIG. 51.

The handles 32 include spindle springs 56 and spindles 38. The handle bases 172 are attached to the inside mounting plates 182 and the inside spindle hubs 188 as described above for the second embodiment of the mortise lock design. Two mounting plates are used, but instead of using the through bolts described above for the mortise lock, the through bolting is achieved with arms 100 (see FIGS. 20-23). The arms act as described previously. Each arm has two threaded openings 106, one at each end. Four screws, two for each mounting plate are used.

When installed, one arm passes above the tubular lock 108 and one arm passes underneath. The arms are inserted first. The tubular lock is then inserted between the arms. A cutout is provided in each arm at 110 (See FIG. 22). This cutout provides space so that the tubular lock fits between the arms, while allowing the screws to be very close to one another on a bolt circle that is less than one inch (25.4 mm).

The arms grab the top and bottom of the tubular lock to provide a secure mount. The handle bases 172 are then threaded onto the respective mounting plates using the tool 200. Lever handles are then placed on the corresponding spindles and setscrews 189 are tightened to complete the assembly.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A spindle hub comprising:

a spindle hub body having an outside perimeter shaped to retract a latchbolt of a mortise lock when the spindle hub is rotated;

the spindle hub body including a central opening shaped to non-rotatably engage a spindle extending into the central opening, the central opening defining a rotational axis for the spindle hub body; and the spindle hub body further including a second opening comprising a curved slot that is substantially offset from the rotational axis of the spindle hub body and having a pair of through bolts passing through the curved slot, the pair of through bolts not interfering with rotation of the spindle hub body.

2. The spindle hub according to claim 1 wherein the outside perimeter of the spindle hub is shaped as an arm to contact and retract the latchbolt when the spindle hub is rotated.

3. The spindle hub according to claim 1 wherein the curved slot has a curved centerline defined by an arc of a circle and a center of curvature located at the rotational axis of the spindle hub body.

4. The spindle hub according to claim 3 wherein the circle defining the curved centerline of the second opening is a through bolt mounting circle having a diameter of less than one inch (25.4 mm).

5. The spindle hub according to claim 3 wherein the curved slot has a minimized width defined by a width of the pair of through bolts passing through the curved slot to provide clearance between the spindle hub body and the pair of through bolts to allow rotation of the spindle hub body relative to the through bolts and wherein the curved slot has a minimized length sufficient to allow rotation of the spindle hub body to retract a latchbolt of a mortise lock, the minimized length and width of the curved slot acting to minimize loss of structural strength of the spindle hub while permitting rotation thereof, whereby the pair of through bolts do not interfere with rotation of the spindle hub body.

6. A spindle hub lock assembly comprising:

first and second spindles;

a first spindle hub shaped to retract a latchbolt when the first spindle hub is rotated via the first spindle;

a second spindle hub shaped to retract the latchbolt when the second spindle hub is rotated via the second spindle;

a first curved slot of the first spindle hub body having a pair of through bolts extending there-through; and a second curved slot of the second spindle hub body having the pair of through bolts extending there-through; and whereby the distance between the pair of through bolts with a rotational axis of the first and second spindles and the first and second curved slots allows the first and second spindle hubs to rotate and retract the latchbolt without interference from the pair of through bolts.

7. The spindle hub according to claim 6 wherein the latchbolt is of a mortise lock.

8. The spindle hub according to claim 6 wherein the first spindle hub having a central opening defining a rotational axis for the first spindle hub.

9. The spindle hub according to claim 8 wherein the second spindle hub having a central opening defining a rotational axis for the second spindle hub.

10. The spindle hub according to claim 6 wherein the first spindle hub has an outside perimeter shaped to retract the latchbolt.

11. The spindle hub according to claim 10 wherein the second spindle hub has an outside perimeter shaped to retract the latchbolt.

12. The spindle hub according to claim 6 wherein the first and second curved slots each have a curved centerline located at a rotational axis.

13. The spindle hub according to claim 12 wherein the curved centerlines of said first and second curved slots are defined by an arc of a circle and a center of curvature located at the rotational axis of the spindle hub.

14. The spindle hub according to claim 13 wherein the curved centerlines are defined by the arc of a bolt circle having a diameter of less than one inch.

15. The spindle hub according to claim 6 wherein the curved centerline of each said first and second curved slots has a center of curvature located at a rotational axis of the spindles and the spindle hubs.

16. The spindle hub according to claim 6 wherein an outside perimeter of the spindle hub is shaped as an arm to contact and retract the latchbolt when the spindle hub is rotated.

17. The spindle hub according to claim 6 wherein the first and second curved slots each having a curved centerline defined by an arc of a bolt circle having a diameter of less than one inch with a center of curvature located at a rotational axis of the spindles and the spindle hubs, the distance between the pair of through bolts with the centerline rotational axis of the spindles and the curved slots of the spindle hubs allows the spindle hubs to rotate and retract the latchbolt without interference from the pair of through bolts.

18. The spindle hub according to claim 6 wherein the first and second curved slots each have a minimized width defined by a width of the through bolts to provide clearance between the spindle hub and the through bolts to allow rotation of the spindle hub relative to the through bolts and wherein the curved slots have a minimized length sufficient to allow rotation of the spindle hubs to retract the latchbolt of a mortise lock, the minimized length and width of the curved slots acting to minimize loss of structural strength of the spindle hubs while permitting rotation thereof.

19. A roseless trim for a tubular lock comprising:

an outside handle base;

an outside handle;

an outside spindle;

an outside bushing extending into the outside handle base and receiving the outside spindle;

an outside mounting plate;

an inside mounting plate;

a pair of arms, one aim extending above the bored in lock and one arm extending below the bored in lock, each arm having a curved outside surface and a cut away portion receiving the bored in lock, the arms being connected to the outside mounting plate at one end and to the inside mounting plate at the other end with bolts on a bolting circle having a diameter of less than one inch;

an inside spindle;

an inside handle base; and an inside handle.

* * * * *